US005729874A

United States Patent [19]

Mizuno

[11] Patent Number: 5,729,874

[45] Date of Patent: Mar. 24, 1998

[54] SLIDER FOR SLIDE FASTENER

[75] Inventor: Hiroshi Mizuno, Toyama, Japan

[73] Assignee: YKK Corporation, Tokyo, Japan

[21] Appl. No.: 769,898

[22] Filed: Dec. 19, 1996

[30] Foreign Application Priority Data

Dec. 21, 1995 [JP] Japan ..... 7-333189

[51] Int. Cl.[6] ..... A44B 1/04

[52] U.S. Cl. ..... 24/429

[58] Field of Search ..... 24/418–425, 427, 24/429, 430, 431

[56] References Cited

U.S. PATENT DOCUMENTS

| | | | |
|---|---|---|---|
| 1,936,095 | 11/1933 | Nicholson | 24/421 |
| 2,262,188 | 11/1941 | Marinsky | 24/419 |
| 2,890,512 | 6/1959 | Stilwell | 24/419 X |
| 5,187,841 | 2/1993 | Takamura et al. | 24/429 |

FOREIGN PATENT DOCUMENTS

| | | | |
|---|---|---|---|
| 798559 | 11/1968 | Canada | 24/421 |
| 524035 | 7/1940 | United Kingdom | 24/429 |

*Primary Examiner*—James R. Brittain

*Attorney, Agent, or Firm*—Hill, Steadman & Simpson

[57] ABSTRACT

A slider for slide fasteners comprises a slider body having a pair of upper and lower wings connected at one end by a neck portion to define a guide channel, a pull tab having a pintle provided at its one end and an attaching lug or lugs provided on the upper surface of the upper wing for pivotally connecting the pintle of the pull tab to the slider body. The upper wing has a land provided on the upper surface of the upper wing and disposed around the attaching lug or lugs. Correspondingly, the pull tab has a recessed surface on each side and adjacent to the pintle for receiving the land when the pull tab rests flat on the upper surface of the upper wing.

7 Claims, 7 Drawing Sheets

SLIDER FOR SLIDE FASTENER

BACKGROUND OF THE INVENTION

1. Field of the Invention

The present invention relates generally to a slider for a slide fastener and more particularly to a slider, whether of the automatic locking type or free type, comprising a slider body and a pull tab, the slider body having means provided on its upper side for pivotally connecting a pintle of the pull tab.

2. Description of the Prior Art

A slider for slide fasteners of the type described comprises a slider body including a pair of the upper and lower wings connected at its front end by a neck portion and a mere flat pull tab pivotally attached to attachment lugs mounted on the upper wing for manipulation of the slider. In such a slider, however, there is no reinforcement on the attaching lugs and those parts of the upper wing of the slider which surround the attaching lugs. Therefore, disadvantageously, those sliders cannot sufficiently endure severe stresses which tend to pull the pull tab during the opening and closing operation of the slider fastener.

Furthermore, recently, there is a tendency to form a slider as thin as possible from the view point of design. However, making the slider thinner should make the pull tab thinner. Therefore, skiers for example often have trouble when griping and manipulating the pull tab of the slider attached to their ski wear while wearing thick gloves.

SUMMARY OF THE INVENTION

With the foregoing difficulties in view, it is therefore an object of the present invention to provide a slider having a strong slider body while being not excessively thick, and a pull tab that can be easily gripped and manipulated even while wearing thick gloves and thereby operate a slider stably.

It is another object of the present invention to provide a slider having a pull tab which is attractive in appearance.

According to the first phase of this invention, there is provided a slider for slide fasteners comprising a slider body having a pair of upper and lower wings connected at one end by a neck portion to define a guide channel, a pull tab having a pintle provided at its one end and means provided on the upper surface of the upper wing for pivotally connecting the pintle of the pull tab to the slider body, the upper wing having a land provided on the upper surface thereof and disposed around the connecting means, the pull tab having a recessed surface formed on each side and adjacent to the pintle for receiving the land when the pull tab rests flat on the upper surface of the upper wing.

According to the second aspect of this invention, the connecting means comprises a pair of opposed front and rear attaching lugs provided on the front and the rear ends, respectively, of the upper wing, the pintle of the pull tab being interposed and fitted between the attaching lugs.

According to the third aspect of this invention, the land has a lateral groove formed thereacross and disposed between the opposed front and rear lugs, the pintle of the pull tab being fitted in the lateral groove.

According to the fourth aspect of this invention, the pull tab has another recessed surface merging with the first-mentioned recessed surface on its each side and extending longitudinally therefrom, thereby leaving a pair of marginal thickened portions on the opposed sides thereof.

According the fifth aspect of this invention, both the recessed surfaces are formed more coarsely than the remaining surfaces of the pull tab.

According to the sixth aspect of this invention, the pull tab adjacent to the pintle conforms to the outline of the slider body, the pull tab being tapered toward its distal end.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

A slider for a slide fastener according to this invention will be described in conjunction with some preferred embodiments with reference to drawings attached hereto.

Figure 1:
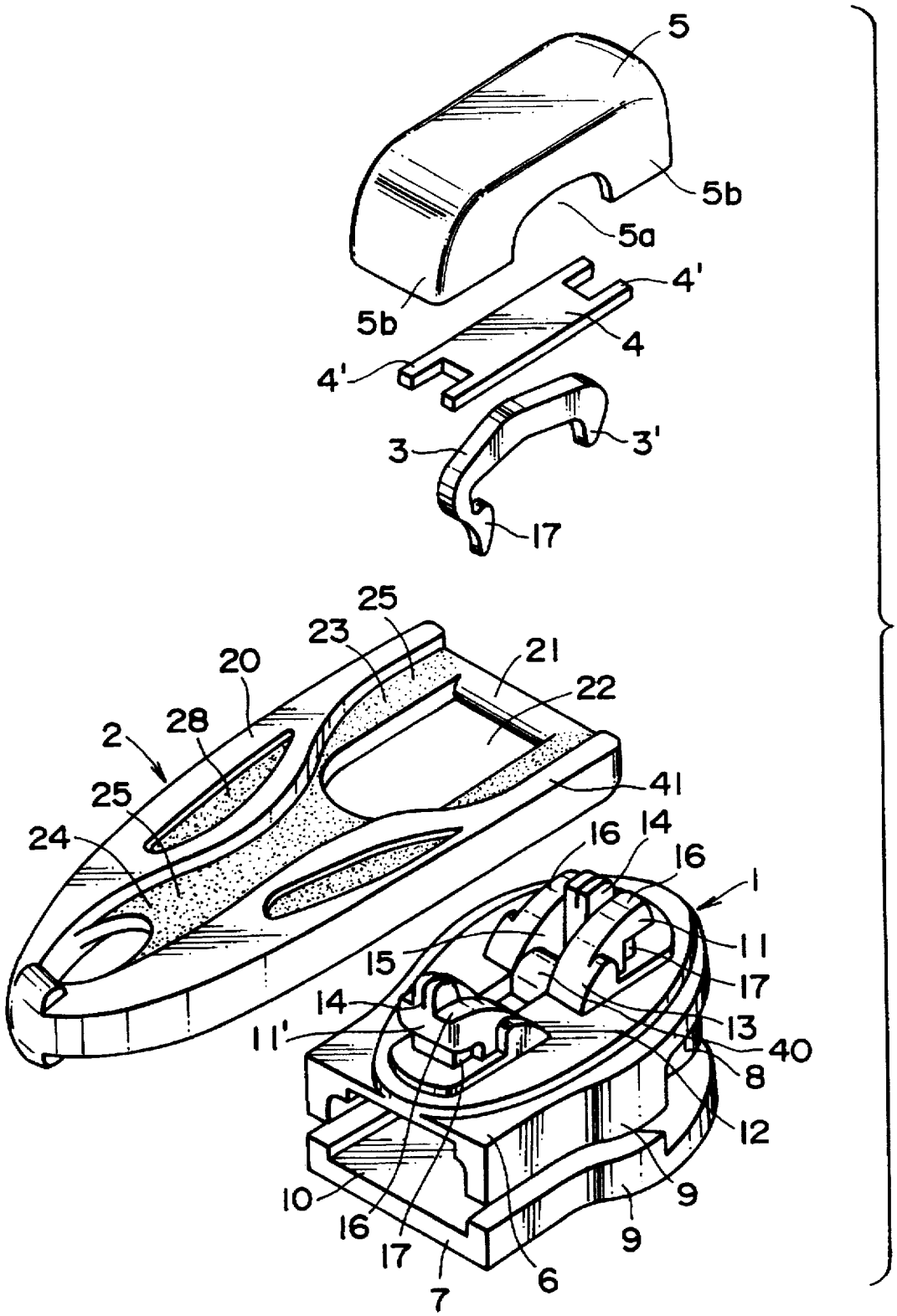
FIG. 1 is an exploded perspective view of a slider for a slide fastener according to the present invention.
Figure 2:
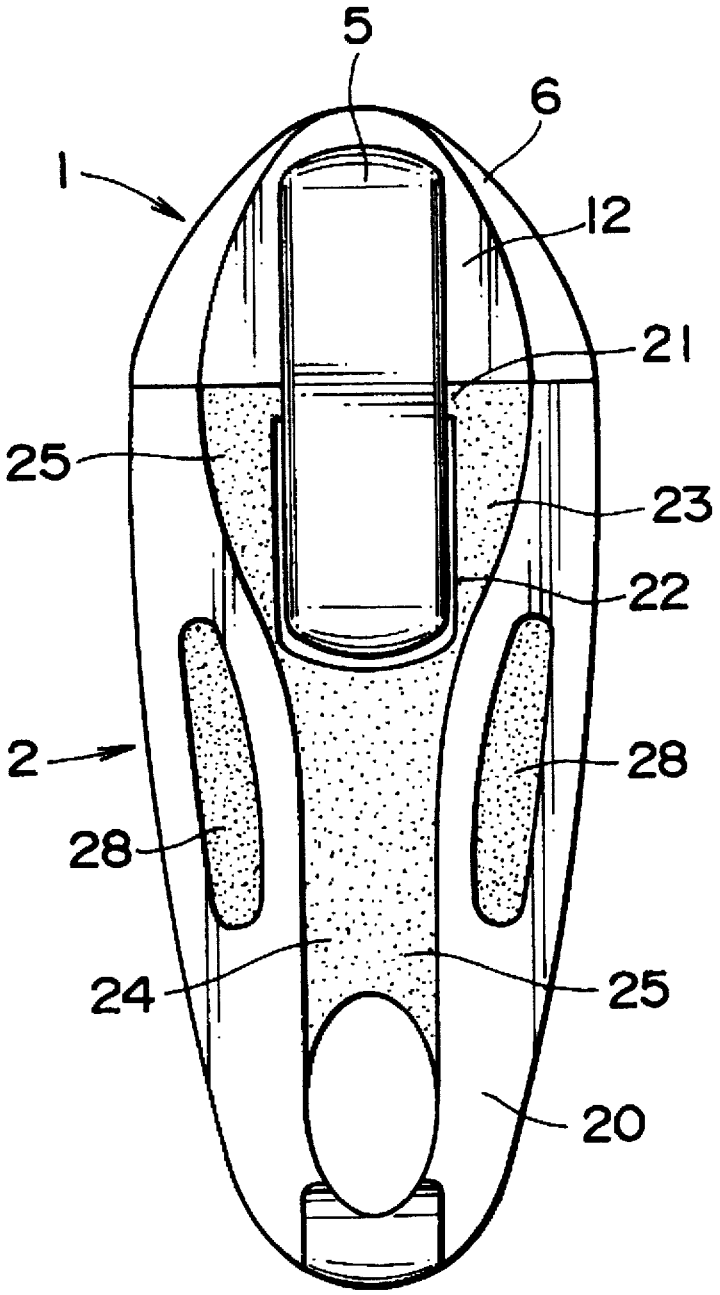
FIG. 2 is a plan view of the slider of FIG. 1.
Figure 3:
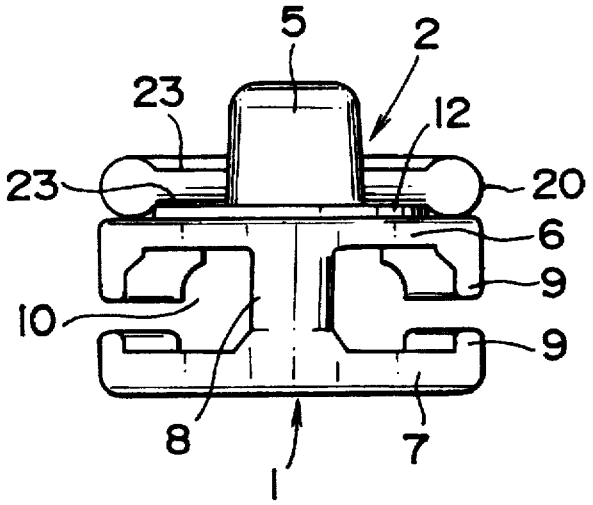
FIG. 3 is a front view of the slider of FIG. 2.
Figure 4:
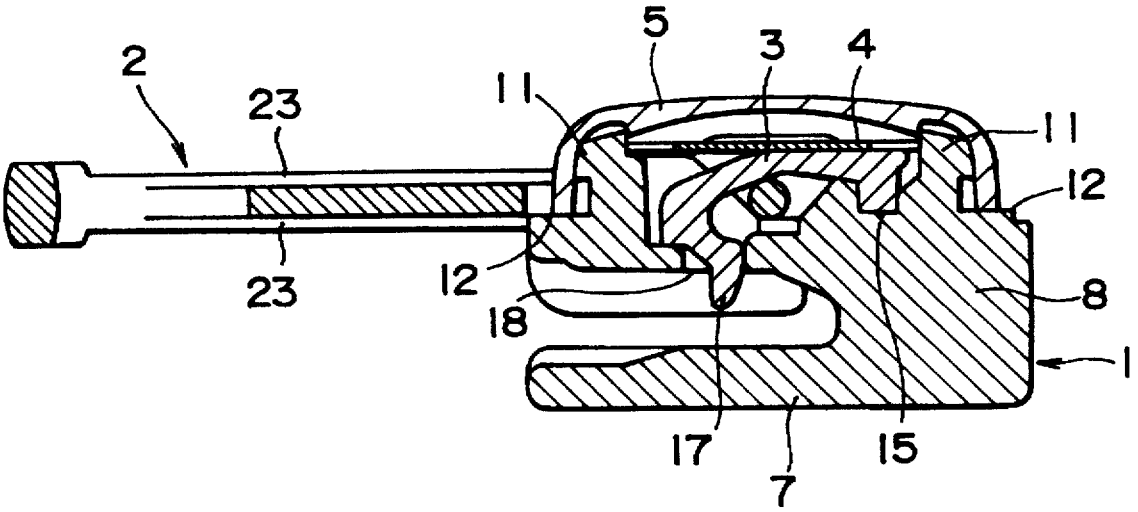
FIG. 4 is a longitudinal cross-sectional view of the slider of FIG. 1.

The slider shown in FIGS. 1 through 4 as a first embodiment is of the automatic locking type, and, as better shown in FIG. 1, broadly comprises a slider body 1, a pull tab 2, a locking lever 3, a plate spring 4 and a cover 5, all these parts being made of metal. The slider body 1 comprises a pair of upper and lower wings 6, 7 connected at the front end by a neck portion 8 to thus define a Y-shaped guide channel 10 for guiding interlocking element rows (not shown) therethrough for opening or closing the slide fastener. Each of the upper and lower wings 6, 7 have a pair of opposed flanges 9, 9 formed on the side edges thereof.

A pair of longitudinally spaced opposed front and rear attaching lugs 11, 11' are provided on the front and the rear ends, respectively, of the upper surface of the upper wing 6. An oval elevated section or land 12 is provided on the upper surface of the upper wing 6 and disposed around the pair of attaching lugs 11, 11', in order to reinforce both the upper wing 6 and the attaching lugs 11, 11'.

The front lug 11 is of the shape of the C-shaped channel and includes confronting side walls 16, 16 extending longitudinally of the slider body 1 and a middle tower 14 connecting the side walls 16, 16 at their respective front ends and projecting upward beyond the side walls 16, 16. The side walls 16, 16 are tapered toward the middle of the upper wing 6 to provide the respective upper slant surfaces 13, 13. The C-shaped lug 11 has an outer recess 17 formed adjacent to the base of the middle tower 14. A protuberance 40 closes the C-shaped front lug 11 at its rear end to thus define with the latter an inner recess 15, as better shown in FIG. 4.

The rear attaching lug 11' is substantially identical in construction with the front attaching lug 11, with the exception that the rear lug 11' has a through hole 18 formed through the upper wing 6 into the Y-shaped guide channel 10 instead of an inner recess 15.

The pull tab 2 has an elongated pull tab body 20 having a bifurcated proximal end 41 and a pintle 21 joined to the bifurcated end 41 to define with the bifurcated end 41 an aperture 22 through which the cover 5 is to be fitted. The pull tab 2 has a proximal recessed surface 23 formed around the aperture 22 on each side thereof for receiving the land 12 when the pull tab 2 rests flat on the upper surface of the upper wing 6. In addition, the pull tab 2 has a distal recessed surface 24 formed on its each side, merging with the proximal recessed surface 23 and extending longitudinally therefrom. Both the proximal and decimal recessed surface 23, 24 are formed more coarsely than the remaining surfaces of the pull tab 2, or both the recess surfaces 23, 24 are embossed for decorative purposes. The pintle 21 is as thick as the recessed surfaces 23, 24. The pull tab 2 adjacent to the pintle 21 conforms to the outline of the slider body 1 and tapers toward the distal end thereof. In addition, the pull tab 2 has a pair of opposed additional recessed surfaces 28, 28 formed on the opposite sides of the distal recessed surface 24, which impart increased aesthetic effect to the pull tab 2. The additional recessed surfaces 28, 28 are also formed coarse or embossed as at reference numeral 25.

The locking lever 3 is of a C-shape and has a pivotal end 3' at one end, and extends arcuately therefrom and terminates in a locking prong 17. The rectangular plate spring 4 has opposed bisected ends 4' 4'. The cover 5 is a box-like configuration, opens downward and is provided at its each side with a side aperture 5*a*, to thus provide opposed legs 5*b*, 5*b* at each end.

To assemble the slider of the construction mentioned above, first a pull tab 2 is placed on the upper wing 6 with the pintle 21 disposed between the front and rear lugs 11, 11' and the recessed surface 23 receiving the oval land 12. Then, the locking lever 3 is placed on the pintle 21 with a front pivotal end 3' pivotally supported in the recess 15 and the locking prong 17 passing through the through hole 18 into the Y-shaped guide channel 10. The plate spring 4 is then bridged between the front and rear attaching lugs 11, 11' with the bisected ends 4' of the former resting on opposed side walls 16, 16 and clamping the middle tower 14. Finally, the cover 5 is placed onto the attaching lugs 11, 11' with the leg 5*b* of the cover 5 fitted into the aperture 22 of the pull tab 2 and with the side apertures 5*a* of the cover 5 receiving the pintle 21. Then, the lower edges of the legs 5*b* of the cover 5 are caulked against the outer recesses 17 of the front and rear lugs 11, 11', so that the cover 5 is fastened to the slider body 1 with the pintle 21 of the pull tab 2, the locking lever 3 and the plate spring 4 held therebetween. The pintle 21 of the pull tab 2 slides along the slant surfaces 13, 13 the front and rear lugs 11, 11' when the pull tab 2 is pulled back and forth in order to reciprocate the slider along the fastener element rows (not shown).

Figure 5:
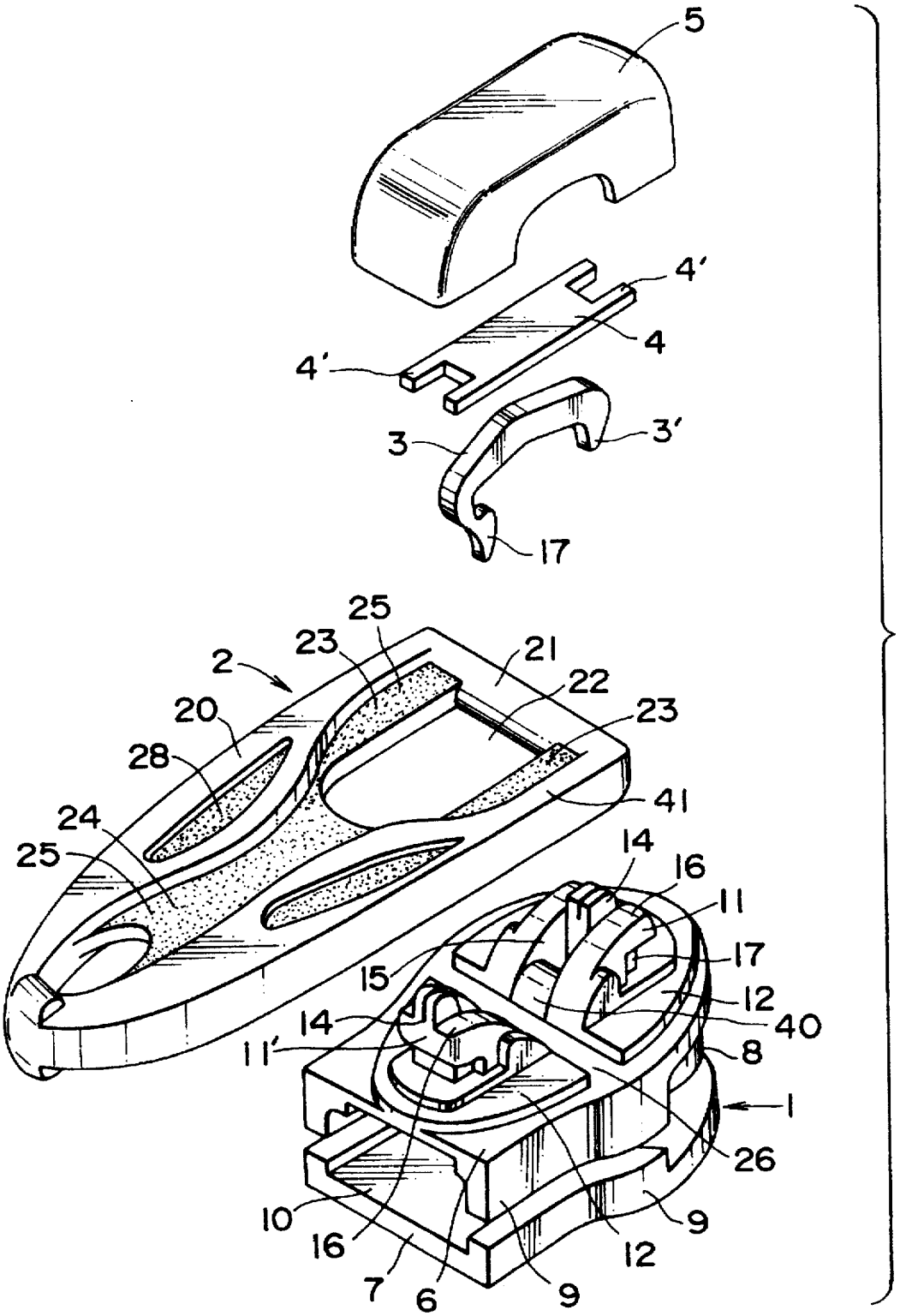
FIG. 5 is an exploded perspective view of a slider for a slide fastener according to another embodiment of the present invention.
Figure 6:
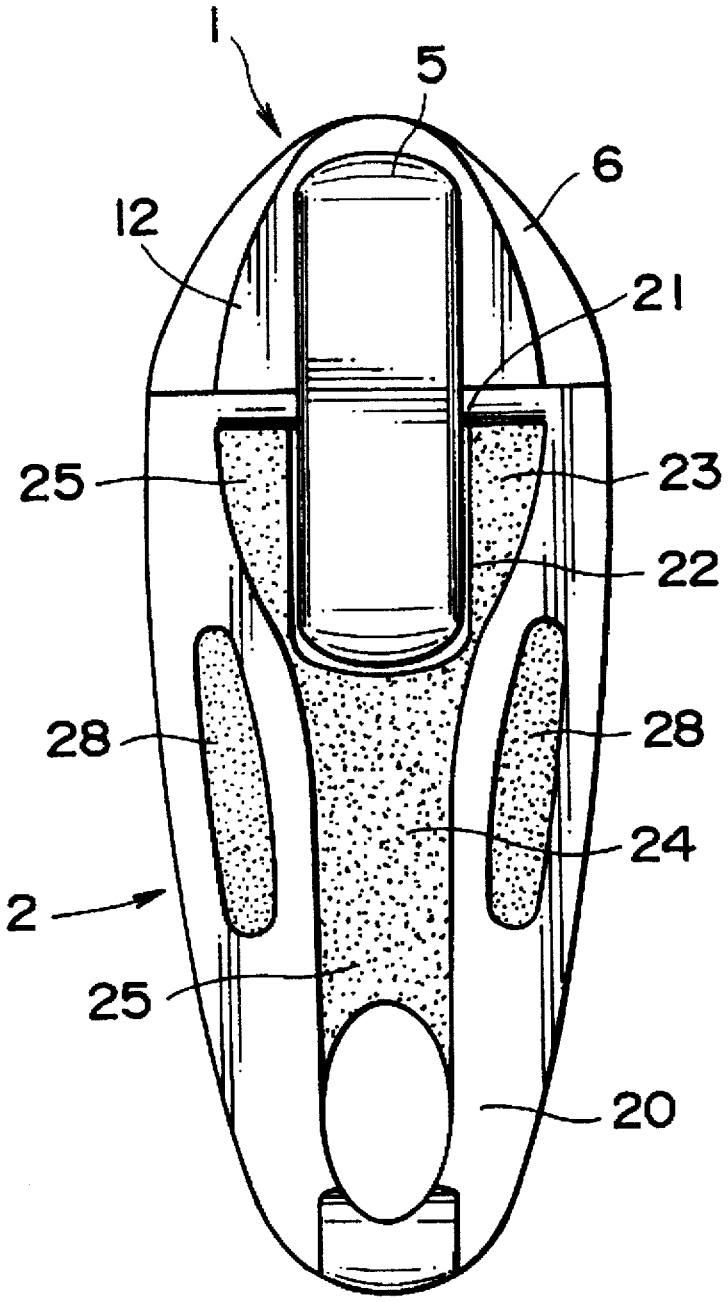
FIG. 6 is a plan view of the slider of FIG. 5.

FIGS. 5 and 6 shows an automatic locking type slider according to a second embodiment. The slider according to the second embodiment is substantially identical with the one according to the preceding embodiment except that the land 12 is formed with a lateral groove 26 between the front and rear attaching lugs 11, 11'. The lateral groove 26 is coplanar with the upper surface of the upper wing 6. Correspondingly, the diameter of the pintle 21 of the pull tab 2 is as great as the thickness of the intact part of the pull tab 2, which helps to reinforce the pull tab 2 as a whole. Furthermore, since the pintle 21 is fitted in the lateral groove 26, the pull tab 2 can be moved more stably in manipulation.

Figure 7:
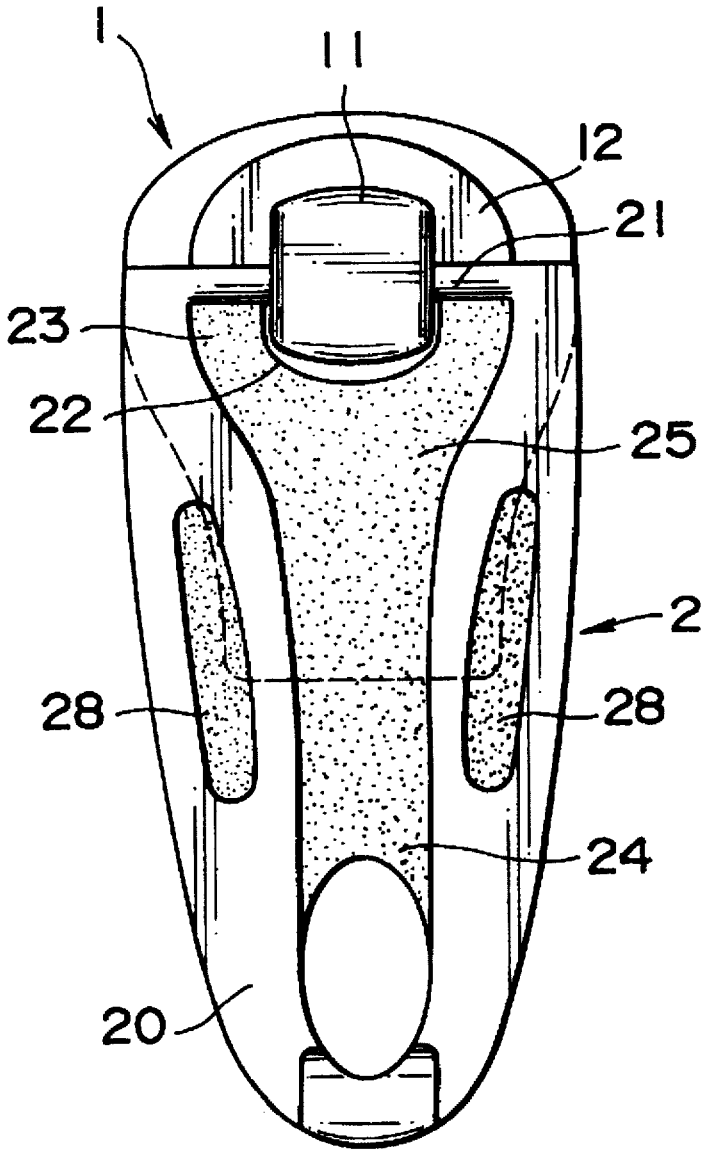
FIG. 7 is a plan view of a slider according to still another embodiment of the present invention.

FIG. 7 shows a so-called free slider according to a third embodiment. "Free" means that the slider is without any locking means. According to the third embodiment, a single attaching lug 11 is provided on the upper surface of the upper wing 6 adjacent to the front end. A pair of coaxial side apertures (not shown) are formed one on each side of the single lug 11. A pair of coaxial pintles 21, 21 are provided on the bifurcated ends of the pull tab 2 so as to extend toward each other but terminate short of each other. The coaxial pintles 21, 21 are forced into the coaxial side apertures so that the pull tab 2 is pivotally mounted on the single attaching lug 11. The recessed surfaces 23 and 24 are substantially identical in construction with those in the preceding embodiments, although, precisely speaking, the outlines of the recessed surfaces 23 and 24 are somewhat different from those in the preceding embodiments. The slider of the shape shown in FIG. 7 may be provided with a locking means, too.

Figure 8:
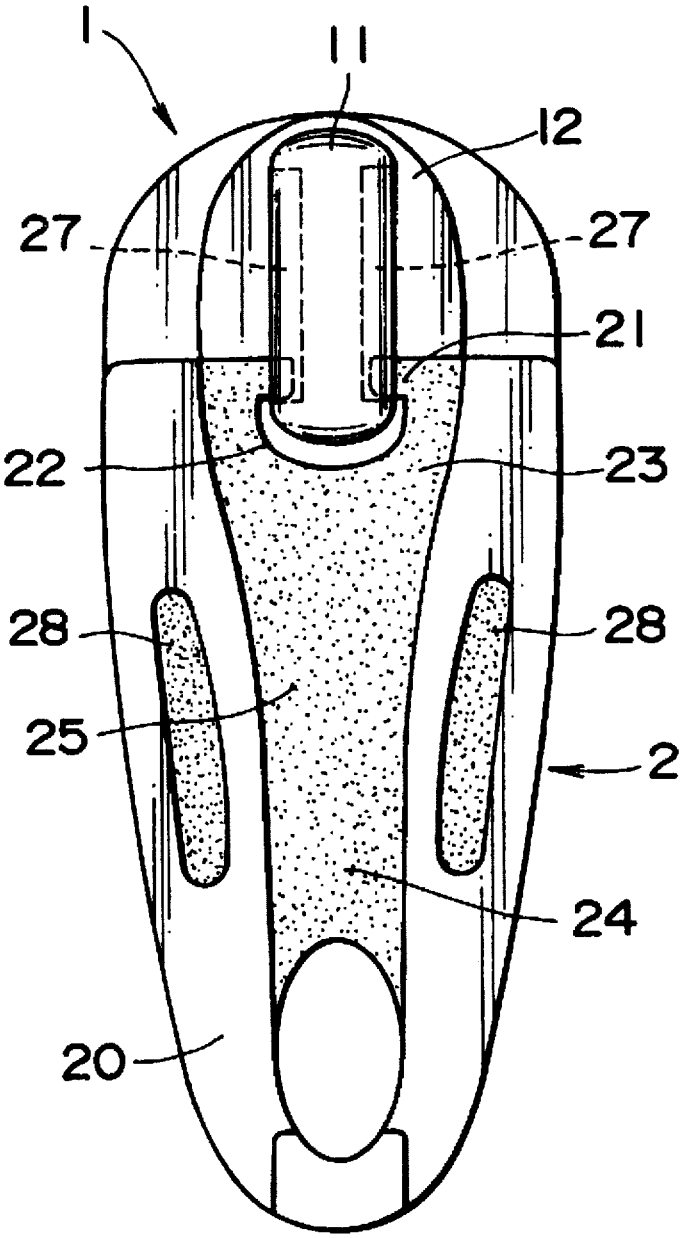
FIG. 8 is a plan view of a slider acceding to yet another embodiment of the present invention.

FIG. 8 shows a slider according to the fourth embodiment of the present invention. The slider is substantially identical with the slider according to the third embodiment, except that the single attaching lug 11 is elongated longitudinally of the slider body 1 and that a pair of coextensive side slots 27, 27 are formed longitudinally one on each side of the single elongated lug 11, instead of the coaxial apertures. A pair of coaxial pintles 21, 21 are provided on the bifurcated ends of the pull tab 2 so as to extend toward each other but terminate short of each other. The coaxial pintles 21, 21 are forced into the coextensive side slots 27, 27 so that the pull tab 2 is pivotally and slidably mounted on the single attaching lug 11.

With the construction mentioned above, the following advantages have been enjoyed by the slider according to the present invention.

Since the land is provided on the upper surface of the upper wing and disposed around the attaching lugs, the slider body is very strong.

Since the recess surface provided on each side of the pull tab receive the land on the upper wing of the slider, this construction advantageously compensates the increased thickness of the slider as a whole caused by the provision of the land. Therefore, although the slider is reinforced by the land, the slider as a whole will never be thickened.

Furthermore, since the remaining parts of the pull tab remain intact or remain thick, even skiers wearing thick gloves can easily handle the pull tab to open and close the slide fastener.

This construction can applied to either a free slider, or an automatic locking slider and so forth.

Since the recessed surfaces are formed more coarsely than the remaining surfaces of the pull tab, this contrast will enhance the aesthetic effect of the pull tab and hence the slider as a whole.

Since the pull tab adjacent to the pintle conforms to the outline of the slider and tapers toward the distal end, this distinctive contour of the pull tab will render the slider and hence slide fastener attractive in appearance, too.

Obviously, various modifications and variations of the present invention are possible in the light of the above teaching. It is therefore to be understood that within the scope of the appended claims the invention may be practiced otherwise than as specifically described.

What is claimed is:

1. A slider for slide fasteners comprising a slider body having a pair of upper and lower wings connected at one end by a neck portion to define a guide channel, the upper wing having an upper surface, a pull tab having a pintle provided at its one end and means provided on the upper surface of the upper wing for pivotally connecting the pintle of the pull tab to the slider body, the upper wing having a land provided on the upper surface of the upper wing and disposed around the connecting means, the pull tab having a recessed surface formed on each side and adjacent to the pintle for receiving the land when the pull tab rests flat on the upper surface of the upper wing.

2. A slider for slide fasteners according to claim 1, the connecting means comprising a pair of opposed front and rear attaching lugs provided on the front and the rear ends, respectively, of the upper wing, the pintle of the pull tab being interposed and fitted between the attaching lugs.

3. A slider for slide fasteners according to claim 2, the land having a lateral groove formed thereacross and disposed between the opposed front and rear lugs, the pintle of the pull tab being fitted in the lateral groove.

4. A slider for slide fasteners according to claim 1, 2 or 3, the pull tab having another recessed surface merging with the first-mentioned recessed surface on its each side and extending longitudinally therefrom, thereby leaving a pair of marginal thickened portions on the opposed sides thereof.

5. A slider for slide fasteners according to claim 4, both the recessed surfaces being formed more coarsely than the remaining surfaces of the pull tab.

6. A slider for slide fasteners according to claim 5, the pull tab adjacent to the pintle conforming to the outline of the slider body, the pull tab being tapered toward its distal end.

7. A slider for slide fasteners according to claim 4, the pull tab adjacent to the pintle conforming to the outline of the slider body, the pull tab being tapered toward its distal end.

* * * * *